US008182178B2

(12) United States Patent
Wang et al.

(10) Patent No.: US 8,182,178 B2
(45) Date of Patent: May 22, 2012

(54) DIRECTIONAL FRACTURE GROUTING METHOD WITH POLYMER FOR SEEPAGE CONTROL OF DIKES AND DAMS

(75) Inventors: Fuming Wang, Zhengzhou (CN); Jianwu Wang, Zhengzhou (CN); Mingsheng Shi, Zhengzhou (CN); Chengchao Guo, Zhengzhou (CN); Yanhui Zhong, Zhengzhou (CN); Bei Zhang, Zhengzhou (CN); Xiaoliang Wang, Zhengzhou (CN)

(73) Assignee: Zhengzhou U-Trust Infrastructure Rehabilitation Ltd., Zhengzhou, Henan Province (CN)

( * ) Notice: Subject to any disclaimer, the term of this patent is extended or adjusted under 35 U.S.C. 154(b) by 265 days.

(21) Appl. No.: 12/721,395

(22) Filed: Mar. 10, 2010

(65) Prior Publication Data

US 2011/0103898 A1 May 5, 2011

(51) Int. Cl.
*E02D 3/12* (2006.01)

(52) U.S. Cl. ..... 405/266; 405/267; 405/269

(58) Field of Classification Search ..... 405/263, 405/264, 265, 266, 267, 268, 269, 270, 107, 405/116, 117
See application file for complete search history.

(56) References Cited

U.S. PATENT DOCUMENTS

| | | | | |
|---|---|---|---|---|
| 2,196,211 | A * | 4/1940 | Hartman | 405/269 |
| 3,690,106 | A * | 9/1972 | Tregembo et al. | 405/266 |
| 3,839,871 | A * | 10/1974 | Dyer et al. | 405/267 |
| 5,026,215 | A * | 6/1991 | Clarke | 405/266 |
| 5,030,036 | A * | 7/1991 | Huff et al. | 405/266 |
| 2001/0041100 | A1 * | 11/2001 | McCabe et al. | 405/269 |

* cited by examiner

*Primary Examiner* — Frederic L Lagman

(57) ABSTRACT

A directional fracture grouting method with polymer for seepage control of dikes and dams includes the steps of: arranging a plurality of directional fracture grouting holes at a predetermined distance along the axis of the dike or dam; forming the directional fracture grouting holes by pushing a special drilling tool; placing a hole-sealing grouting pipe and a fracture grouting pipe into each of the directional fracture holes; and injecting including the steps of firstly injecting a small amount of polymer material into the sealing-hole pipe, and secondly injecting predetermined amount of material into the fracture grouting pipe. Under the chemical reaction, the mixed material expands, fractures the soil along the guided directions, and forms a super thin polymer segment. Finally, the polymer segments are overlapped each other, and the seepage control system is constructed inside the dike or dam.

20 Claims, 3 Drawing Sheets

DIRECTIONAL FRACTURE GROUTING METHOD WITH POLYMER FOR SEEPAGE CONTROL OF DIKES AND DAMS

BACKGROUND OF THE PRESENT INVENTION

1. Field of Invention

The present invention relates generally to methods for hydraulic infrastructures reinforcement and rehabilitation, and more particularly to a directional fracture grouting method with polymer for seepage control of dikes and dams.

2. Description of Related Arts

The safety of hydraulic infrastructures such as reservoirs is one of the top priority safety concerns. If a reservoir collapses, it could cause heavy damages to properties or even casualties. Seepage, a problem commonly associated with dams or dikes, is generally considered as a hidden danger. Many dam disasters were caused by the failure of their seepage control systems. Various solutions have been proposed. Among the available options, fracturing or splitting grouting is a commonly used method or technique.

The theory base for fracturing grouting is that the minimum principal stress plane is parallel or in the same direction as the axial direction of a dike or dam. Based on this theory and the principles of hydraulic fracturing, the technique of fracturing grouting comprises drilling holes along the axis of a dike or dam where the reinforcement mechanism is supposed to be installed. A grout composition is then injected into the holes. Under the hydraulic fracturing effect and the injecting pressure energy, the grout composition forces its way into hidden cracks, holes, fills up the voids and gets the soil compacted. As a result, it forms vertical, continuous, and impermeable barriers inside the dike or dam, thus achieving seepage control and dam reinforcement. Cement slurry is commonly used in the fracturing grouting technique, which has the following shortcomings:

(1) Grouting holes are typically large in size, which could undermine the safety or the structural soundness of the dike or dam;

(2) Grouting pressure is not easily controlled;

(3) Cement slurry may not be able to reach every crack or hole. It is especially so for the deeper areas where the slurry may not be able to be distributed effectively;

(4) For purpose of seepage control, a continuous curtain is required to form along the axial direction of the dike or dam, but it is hard to use the fracturing grouting technique to guide the cement flow to form a continuous curtain;

(5) Grouting process is time consuming and labor intensive;

(6) After the cement slurry sets, a rigid curtain is formed within the dike or dam. Deformation or cracking are likely to occur because the rigidness of the concrete wall is not good at adapting itself to the change or shift of the surrounding soil.

It is clear that the existing fracturing grouting technique can't satisfactorily meet the requirements for seepage control of dikes and dams. Developing a better and more effective technique for seepage control for dikes and dams has become imperative.

Grouting with polymer, a technique developed since 1970s, allows rapid treatment for foundation repair. It has been used to reinforce foundations, fill up hollow spaces underground, or elevate floor by injecting two-component polymer materials into the foundation which then expands under chemical reaction and then coagulates. At present, grout polymer has been applied mostly in foundation repair or road maintenance. There is no report about techniques of directional fracture grouting with polymer for dikes and dams.

SUMMARY OF THE PRESENT INVENTION

An object of the present invention is to provide a directional fracture grouting method with polymer for seepage control of dikes and dams to use non-water reacted two-component polymeric material to form super thin polymer segments. The segments overlap each other so as to construct a continuous super-thin polymer seepage control system inside a dike or dam.

Another object of the present invention is to provide a directional fracture grouting method with polymer for seepage control of dikes and dams to construct a polymer seepage control system which has improved impermeability and durability.

Another object of the present invention is to provide a directional fracture grouting method with polymer for seepage control of dikes and dams to construct a polymer seepage control system which is a fast reinforcement technique as the polymer composition achieves more than 90% of its full strength under chemical reaction in about 15 minutes after being injected.

Another object of the present invention is to provide a directional fracture grouting method with polymer for seepage control of dikes and dams to construct a polymer seepage control system of which its thickness and density of the curtain can be optimized in accordance to project-specific requirements, making rooms for cost saving.

Another object of the present invention is to provide a directional fracture grouting method with polymer for seepage control of dikes and dams to construct a polymer seepage control system which is able to produce polymer grout curtains just a few millimeters thick and has minimal disturbing impact to dikes and dams during construction.

Thereby, in order to accomplish the above objects, the present invention provides a directional fracture grouting method with polymer for seepage control of dikes and dams, comprising the steps of:

(1) determining the positions of the seeping layers or zones in a dam that need to be reinforced by using available geophysical detecting technologies or devices and then assessing the seeping problems found in the dike or dam;

(2) arranging a plurality of directional fracture grouting holes at a predetermined distance along an axis of the dike or dam and at predetermined sections to get ready for hole forming;

(3) constructing the directional fracturing holes by pushing a special drill tool, a cylinder drill bit with two wings, into a predetermined depth of the soil using a direct pushing method with hydraulic equipment such as static cone penetration systems, wherein a concave side of each of the directional fracture grouting holes faces toward an upstream of the dike or dam;

(4) placing a hole-sealing grouting pipe and a polymer grout pipe with predetermined length into each of the directional fracture grouting holes; and (5) injecting a polymer material comprising the steps of firstly injecting a small amount of polymer material to the hole-sealing pipe to seal the holes and secondly injecting predetermined amount of material into the directional fracture polymer grouting pipe, wherein the material injected is non-water reacted two-component polymeric composition, and a two-component polymer injection system is employed.

Thereby, under the chemical reaction of the two components of the polymer, the mixed material expands and becomes foamed solid from liquid, generating an expanding power inside the soil of the dike or dam. When the expanding force exceeds the tensile strength of soil, the soil is fractured along the intended splitting directions guided by the two wings of the special drilling tool, and the material forms a super thin polymer segment. The polymer segments are overlapped each other, and the seepage control system is constructed inside the dike or dam.

These and other objectives, features, and advantages of the present invention will become apparent from the following detailed description, the accompanying drawings, and the appended claims.

DETAILED DESCRIPTION OF THE PREFERRED EMBODIMENT

Referring to FIGS. 1 to 6 of the drawings, a directional fracture grouting method with polymer for seepage control of dikes and dams according to a preferred embodiment of the present invention is illustrated, which comprises the steps of:

(1) determining positions of seeping layers or zones in a dam which needs to be reinforced by using geophysical detecting technologies or devices and then assessing seeping problems found in the dike or dam;

(2) arranging a plurality of directional fracture grouting holes 10 at a predetermined distance along an axis of the dike or dam and at predetermined sections to get ready for holes forming;

(3) forming the directional fracture grouting holes 10 by pushing a special drilling tool 20, a cylinder drill bit with two wings, into a predetermined depth of the soil using a direct pushing method with hydraulic equipment such as a static cone penetration system, wherein a concave side of each of the directional fracture grouting holes 10 faces toward an upstream of the dike or dam;

(4) placing a hole-sealing grouting pipe 30 and a polymer fracture grouting pipe 40 with a predetermined length into each of the directional fracture grouting holes 10; and (5) injecting a polymer material comprising the steps of firstly injecting a small amount of polymer material to the hole-sealing pipe 30 to seal each of the directional fracture grouting holes; and secondly injecting a predetermined amount of material into the fracture grouting pipe 40, wherein the material injected is a non-water reacted two-component polymeric composition, and a two-component polymer injection system is employed.

Figure 1:
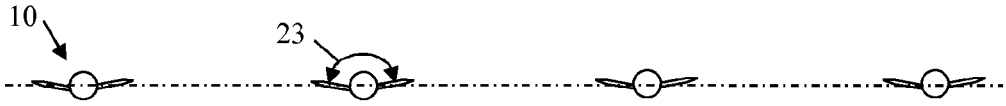
FIG. 1 is a site layout of a plurality of directional fracture grouting holes according to a preferred embodiment of the present invention.
Figure 2:
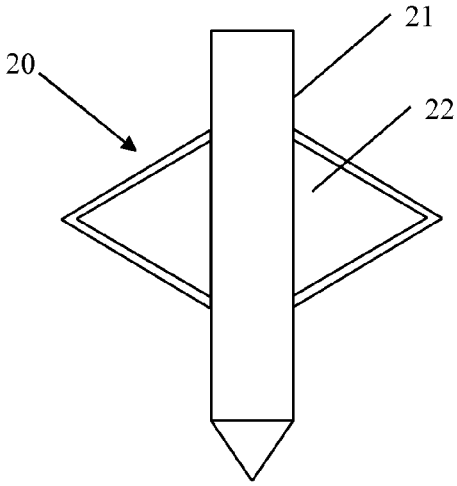
FIG. 2 is a schematic view of a drilling tool according to the above preferred embodiment of the present invention.
Figure 3:
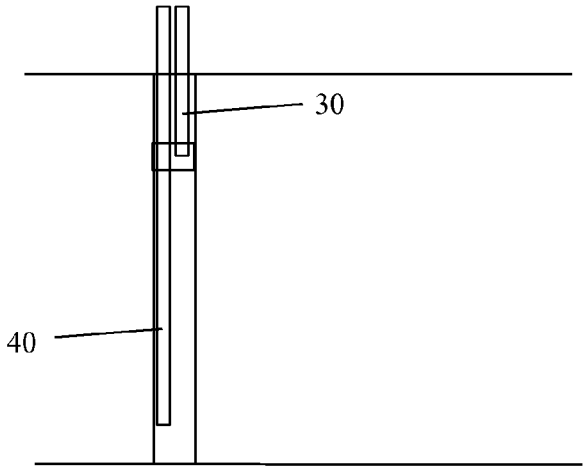
FIG. 3 is a schematic view of a hole-sealing grouting pipe and a fracture grouting pipe placed into one of the directional fracture grouting holes according to the above preferred embodiment of the present invention.
Figure 4:
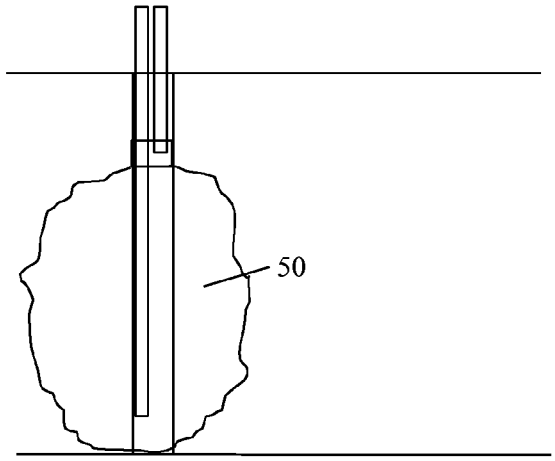
FIG. 4 is a grouting effect view of single directional fracture grouting hole.
Figure 5:
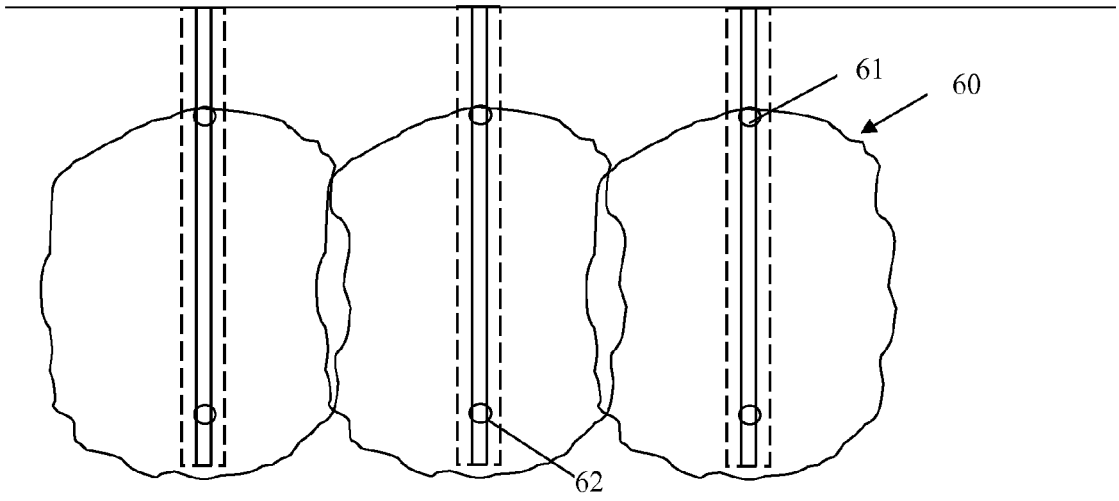
FIG. 5 shows a super thin polymer seepage control system formed by a plurality of directional fracture grouting.
Figure 6:
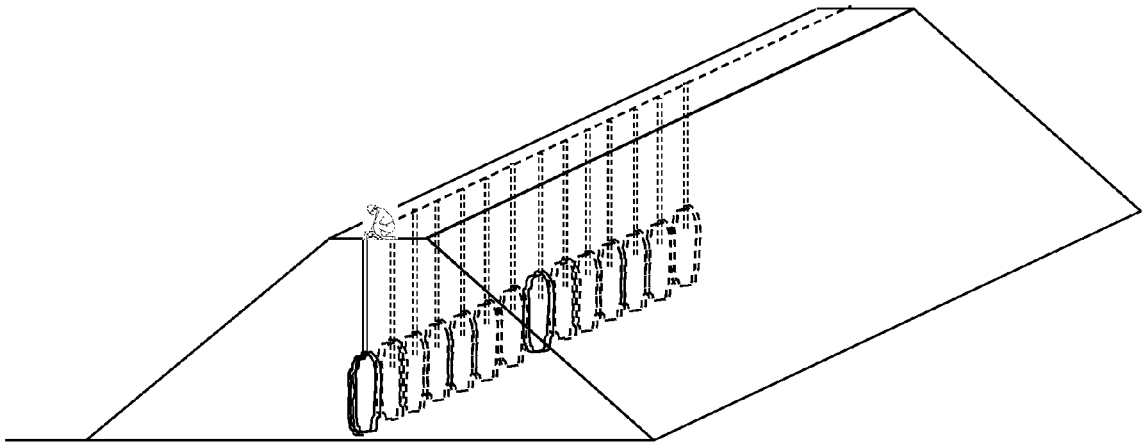
FIG. 6 is a schematic view of the super thin polymer seepage control system in the dike or dam.

Thereby, under the chemical reaction of the two components of the polymer, the mixed material expands and becomes foamed solid from liquid, generating an expanding power inside the soil of the dike or dam. When the expanding force exceeds the tensile strength of soil, the soil is fractured along original splitting directions guided by the two wings 22 of the special drilling tool 20, and the material forms a super thin polymer segment 50. Finally, the polymer segments are overlapped each other, and the seepage control system 60 is constructed inside the dike or dam. (61 shown in FIG. 5 is a sealing-hole grouting point, 62 shown in FIG. 5 is a fracture grouting point).

As a side note—the field tests and theory modeling done by the inventor have shown that if the drilling holes were round, due to the non-homogeneous nature of soil, the expanding force generated by the injected polymer material under chemical reaction will fracture the soil from the relatively weak zones first, and then goes wherever the splitting or cracking goes. Because of the complexity of soil, the splitting or fracturing directions can not be determined or controlled.

In summary, the present invention provides a novel concept and technique for guiding the polymer grout to fracture the soil in a directional manner. Different from the conventional splitting grouting holes, the directional fracture grouting holes are not round. They are formed by using a special drilling tool 20 to split the soil at two sides of the round hole according to a predetermined angle. The effect is that once the polymer material is injected into the directional fracture grouting hole and expanded under the chemical reaction, the soil is fractured by the expanding force, along the intended splitting directions guided by the special drilling tool 20. Then as the polymer material further expands within the hole and the split soil, the soil will be further fractured generally along the intended splitting direction.

Because the directional fracture grouting holes are not round, they cannot be formed by the common drilling tools and methods. The present invention provides a direct pushing method and uses a hydraulic equipment such as a static cone penetration system to push a special drilling tool 20 into a predetermined depth of the soil, and thus to form the directional fracture grouting hole 10.

The special drilling tool 20 comprises a cylindrical drill bit 21 and two wings 22 welded at two sides thereof according to a predetermined angle, respectively. When the drilling tool 20 is pushed into the soil, the two wings 22 split simultaneously the soil to form each of the directional fracture grouting holes 10. Each of the two wings 22 is designed to have a triangle-like shape such as an equilateral triangle, a semicircle, or any other shapes of suitable to be pushed into soil, a height of which is 6-8 cm in general and is adjustable according to the characteristics of soil.

As mentioned above, the two wings 22 are welded at the cylindrical drill bit 21 according to a predetermined angle $\alpha$23. In order to lap conveniently, the predetermined angle 23 is set to 160-170 degrees facing upstream and is adjustable.

Preferably, the predetermined distance between two adjacent directional fracture grouting holes 10 is about 1 m, and is adjustable. If the predetermined distance is too far, it is difficult for the super-thin polymer segments 50 to lap over each other. If the predetermined distance is too close, the efficiency of constructing the super-thin polymer seepage control system 60 is lowered.

In general, a length of the hole-sealing grouting pipe 30 is set to 1 m below the ground surface, and is adjustable. A length of the fracture grouting pipe 40 is determined according to actual situation of project.

Compared with the traditional methods for seepage control of dikes and dams, the directional fracture grouting method with polymer for seepage control of dikes and dams provided by the present invention has following characteristics of:

(1) Improved impermeability. After chemical reactions, the polymer material forms a foam-like solidified material which is stable and has an underground service life more than 100 years. The foam-like solidified material is superior in impermeability. Being flexibility, it binds soil firmly and is able to adapt to the shift of the surrounding soil. Therefore, the polymer material surpasses the prior art in impermeability and durability.

(2) Shorter construction time. The directional fracture grouting method for using polymer grout for seepage control for dikes and dams provided by the present invention constructs a seepage control system quicker than other methods because the polymer material achieves more than 90% of its final strength in about 15 minutes after being injected under chemical reaction. It is the fastest method for constructing seepage control system for dikes and dams. Compared with the prior art, it shortens the construction time by more than 70%.

(3) Lower cost. With the directional fracture grouting method with polymer for seepage control of dikes and dams provided by the present invention, the process of constructing a polymer seepage control system can be optimized according to the actual situation of project to reduce cost.

(4) Minimal disturbing impact on dikes or dams. The directional fracturing method for using polymer grout for seepage control for dikes and dams provided by the present invention is able to produce polymer grout curtains just a few millimeters thick. It is by far the thinnest, lightest impermeable contain and it has the least disturbing impact to dams during construction as compared to that done by other impermeable systems or methods.

All in all, the present invention provides a directional fracture grouting method with polymer for seepage control of dikes and dams, and develops a novel method to combat seepage problems associated with dikes or dams. Some of the advantages include faster construction turnaround time, better impermeability, lower cost, and minimal disturbing impact to dams and dikes.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and are subject to change without departure from such principles. Therefore, this invention includes all modifications encompassed within the spirit and scope of the following claims.

What is claimed is:

1. A directional fracture grouting method with polymer for seepage control of dikes and dams, comprising the steps of:

(1) determining positions of permeable layers to deal with by comprehensively detecting the dike or dam using a geophysical technology, and analyzing seepage situations of the dike or dam;

(2) arranging a plurality of directional fracture grouting holes at a predetermined distance along an axis of the dike or dam and at predetermined sections to construct a seepage control system;

(3) forming the directional fracture grouting holes by pushing a special drilling tool, a cylindrical drill bit with two wings, into a predetermined depth of soil using a direct pushing method with hydraulic equipment, wherein a concave surface of each of the directional fracture grouting holes is provided towards an upstream of the dike or dam;

(4) placing a sealing-hole grouting pipe and a fracture grouting pipe with a predetermined length, into each of the directional fracture grouting holes; and (5) injecting a polymer material comprising the steps of firstly injecting a small amount of polymer material into the sealing-hole grouting pipe to seal each of the directional splitting grouting holes; and secondly injecting a predetermined amount of material into the fracture grouting pipe, wherein the material injected is a non-water reacted two-component polymeric composition, and a two-component polymer injection system is employed, thereby, under the chemical reaction of two components of the polymer, the mixed material expands and becomes foamed solid from liquid, generating an expanding power inside the soil of the dike or dam, when the expanding force exceeds a tensile strength of soil, the soil is fractured along original splitting directions guided by the two wings of the special drilling tool, and the material forms a super-thin polymer segment, finally, the polymer segments are overlapped each other, and the seepage control system is constructed inside the dike or dam.

2. The directional fracture grouting method with polymer for seepage control of dikes and dams, as recited in claim 1, wherein the special drilling tool comprises a cylindrical drill bit and two wings welded at two sides thereof according to a predetermined angle, respectively.

3. The directional fracture grouting method with polymer for seepage control of dikes and dams, as recited in claim 2, wherein each of the two wings is designed as a triangle, a semicircle, or any other shapes of suitable to be pushed into soil, and is adjustable.

4. The directional fracture grouting method with polymer for seepage control of dikes and dams, as recited in claim 3, wherein a height of each of the two wings is in the range of 6-8 cm, and is adjustable.

5. The directional fracture grouting method with polymer for seepage control of dikes and dams, as recited in claim 2, wherein the two wings are welded at the cylindrical drill pipe according to a predetermined angle $\alpha$, wherein the predetermined angle $\alpha$ is set to 160-170 degrees upstream, and is adjustable.

6. The directional fracture grouting method with polymer for seepage control of dikes and dams, as recited in claim 3, wherein the two wings are welded at the cylindrical drill pipe according to a predetermined angle $\alpha$, wherein the predetermined angle $\alpha$ is set to 160-170 degrees upstream, and is adjustable.

7. The directional fracture grouting method with polymer for seepage control of dikes and dams, as recited in claim 4, wherein the two wings are welded at the cylindrical drill pipe according to a predetermined angle $\alpha$, wherein the predetermined angle $\alpha$ is set to 160-170 degrees upstream, and is adjustable.

8. The directional fracture grouting method with polymer for seepage control of dikes and dams, as recited in claim 1, wherein the predetermined distance between two adjacent directional fracture grouting holes is set to 1 m, and is adjustable.

9. The directional fracture grouting method with polymer for seepage control of dikes and dams, as recited in claim 3, wherein the predetermined distance between two adjacent directional fracture grouting holes is set to 1 m, and is adjustable.

10. The directional fracture grouting method with polymer for seepage control of dikes and dams, as recited in claim 4, wherein the predetermined distance between two adjacent directional fracture grouting holes is set to 1 m, and is adjustable.

11. The directional fracture grouting method with polymer for seepage control of dikes and dams, as recited in claim 5, wherein the predetermined distance between two adjacent directional fracture grouting holes is set to 1 m, and is adjustable.

12. The directional fracture grouting method with polymer for seepage control of dikes and dams, as recited in claim 6, wherein the predetermined distance between two adjacent directional fracture grouting holes is set to 1 m, and is adjustable.

13. The directional fracture grouting method with polymer for seepage control of dikes and dams, as recited in claim 7, wherein the predetermined distance between two adjacent directional fracture grouting holes is set to 1 m, and is adjustable.

14. The directional fracture grouting method with polymer for seepage control of dikes and dams, as recited in claim 2, wherein a length of the sealing-hole grouting pipe is set to 1 m below the ground surface, and is adjustable, a length of the fracture grouting pipe is determined according to the actual situation of project.

15. The directional fracture grouting method with polymer for seepage control of dikes and dams, as recited in claim 4, wherein a length of the sealing-hole grouting pipe is set to 1 m below the ground surface, and is adjustable, a length of the fracture grouting pipe is determined according to the actual situation of project.

16. The directional fracture grouting method with polymer for seepage control of dikes and dams, as recited in claim 5, wherein a length of the sealing-hole grouting pipe is set to 1 m below the ground surface, and is adjustable, a length of the fracture grouting pipe is determined according to the actual situation of project.

17. The directional fracture grouting method with polymer for seepage control of dikes and dams, as recited in claim 7, wherein a length of the sealing-hole grouting pipe is set to 1 m below the ground surface, and is adjustable, a length of the fracture grouting pipe is determined according to the actual situation of project.

18. The directional fracture grouting method with polymer for seepage control of dikes and dams, as recited in claim 10, wherein a length of the sealing-hole grouting pipe is set to 1 m below the ground surface, and is adjustable, a length of the fracture grouting pipe is determined according to the actual situation of project.

19. The directional fracture grouting method with polymer for seepage control of dikes and dams, as recited in claim 11, wherein a length of the sealing-hole grouting pipe is set to 1 m below the ground surface, and is adjustable, a length of the fracture grouting pipe is determined according to the actual situation of project.

20. The directional fracture grouting method with polymer for seepage control of dikes and dams, as recited in claim 13, wherein a length of the sealing-hole grouting pipe is set to 1 m below the ground surface, and is adjustable, a length of the fracture grouting pipe is determined according to the actual situation of project.

* * * * *